United States Patent [19]

Rhodes

[11] 4,225,420

[45] Sep. 30, 1980

[54] PROCESS FOR IMPROVING SOLUBLE COAL YIELD IN A COAL DEASHING PROCESS

[75] Inventor: Donald E. Rhodes, Oklahoma City, Okla.

[73] Assignee: Kerr-McGee Corporation, Oklahoma City, Okla.

[21] Appl. No.: 52,611

[22] Filed: Jun. 27, 1979

[51] Int. Cl.[3] ..... C10G 1/04; C10G 29/20

[52] U.S. Cl. ..... 208/177; 208/8 LE

[58] Field of Search ..... 208/177, 8 LE

[56] References Cited

U.S. PATENT DOCUMENTS

| | | | |
|---|---|---|---|
| 3,791,956 | 2/1974 | Gorin et al. | 208/8 LE |
| 4,070,267 | 1/1978 | Leonard | 208/8 LE |
| 4,162,965 | 7/1979 | Clapper | 208/177 |
| 4,164,466 | 8/1979 | Baldwin et al. | 208/177 |

*Primary Examiner*—Herbert Levine

*Attorney, Agent, or Firm*—William G. Addison

[57] ABSTRACT

Coal liquefaction products are contacted with a deashing solvent and introduced into a first separation zone. The first separation zone is maintained at an elevated temperature and pressure, determined to maximize the recovery of soluble coal products, to cause said coal liquefaction products to separate into a first light phase and a first heavy phase. Under these conditions the heavy phase while still fluid-like in character is substantially non-flowable. Flowability is returned to the fluid-like heavy phase by the introduction of an additional quantity of deashing solvent into the first separation zone at a location below the interface between the first light and heavy phases or into the heavy phase withdrawal conduit during withdrawal of the first heavy phase and prior to any substantial pressure reduction. The first heavy phase then is withdrawn from the first separation zone for additional downstream processing without plugging either the withdrawal conduit or the downstream apparatus. The first light phase comprising the soluble coal products is withdrawn and recovered in an increased yield to provide a more economical coal deashing process.

10 Claims, 2 Drawing Figures

PROCESS FOR IMPROVING SOLUBLE COAL YIELD IN A COAL DEASHING PROCESS

The Government of the United States of America has rights in this invention pursuant to Contract No. EX-76-C-01-2270 awarded by the U.S. Department of Energy.

BACKGROUND OF THE INVENTION

1. Field of the Invention

This invention relates to a process for the improved recovery of soluble coal products from a continuous coal deashing process.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717, assigned to the same assignee as the present invention, describe processes wherein coal liquefaction products are contacted with a deashing solvent and the resulting mixture is introduced into a separation zone maintained at elevated temperature and pressure and separated into a heavy phase containing the insoluble coal products and a light phase containing the soluble coal products. When the separation is effected under the proper conditions of temperature and pressure, the heavy phase is easily flowable from the separation zone for withdrawal therefrom. However, if conditions are adjusted to increase the yield of soluble coal products recovered as the light phase beyond a certain extent, the heavy phase is no longer easily flowable. When attempts are made to remove such heavy phase (even though it is fluid-like) the withdrawal conduit or the downstream processing apparatus may become plugged by solidified heavy phase material. Once the fluid-like heavy phase solidifies within the process apparatus, it can only be returned to its fluid-like condition by the introduction of soluble coal products or other high-boiling aromatic materials. Such use of the soluble coal products necessarily results in a substantially lower net recovery of deashed soluble coal products from the process.

U.S. Pat. Nos. 3,947,346 and 3,954,595, describe processes wherein coal liquefaction products are contacted with a promoter liquid to separate insoluble coal products. The mixture of coal liquefaction products and promoter liquid is introduced into a gravity settler wherein the insoluble coal products separate as an underflow that is withdrawn and stripped to recover a portion of the remaining soluble coal products. Those patents disclose that to maintain the stripped solid-containing stream flowable, the stream should contain sufficient soluble coal to provide a benzene solubles content of at least 35 percent. Normally, the benzene solubles content of the stripped solid-containing stream is in the range of from about 40 to 60 percent.

It is desirable to provide a process by which coal liquefaction products can be treated to separate insoluble coal products from the soluble coal products with a minimum loss of valuable soluble coal products while still maintaining the stream in a flowable condition.

SUMMARY OF THE INVENTION

The discovery now has been made that coal liquefaction products can be deashed under conditions which maximize the yield of recovered soluble coal products by a process that restores the flowability of the fluid-like heavy phase that is separated from the soluble coal products within a separation zone.

In accordance with the process of the present invention, coal liquefaction products comprising soluble coal products and insoluble coal products are contacted with a deashing solvent and introduced into a first separation zone. The first separation zone is maintained at an elevated temperature and pressure, determined to maximize the recovery of soluble coal products, to cause said coal liquefaction products to separate into a first light phase and a first heavy phase, said heavy phase comprising the insoluble coal products. Under these conditions, the heavy phase while still fluid-like in character is substantially non-flowable. The flow-ability of the fluid-like heavy phase is restored by the introduction of an additional quantity of deashing solvent into the first separation zone at a location below the interface between the first light and heavy phases or into the heavy phase withdrawal conduit during withdrawal of the first heavy phase and prior to any substantial pressure reduction.

The first heavy phase then is withdrawn from the first separation zone for additional downstream processing without plugging either the withdrawal conduit or the downstream apparatus. The first light phase comprising the soluble coal products is withdrawn from the first separation zone and recovered.

The enhanced separation of the present invention produces soluble coal products in an increased yield to thereby provide a more economical coal deashing process.

DESCRIPTION OF THE PREFERRED EMBODIMENT

Figure 1:
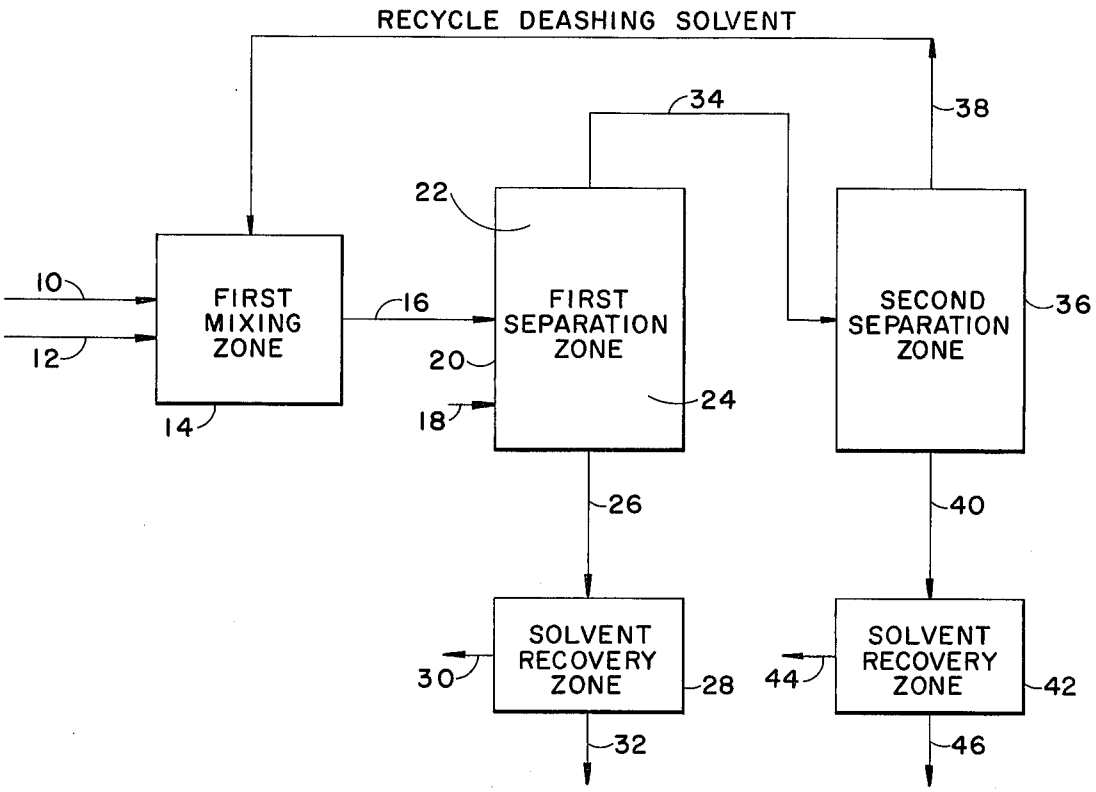
FIG. 1 schematically illustrates one embodiment of the invention.

Turning now to FIG. 1, a feed comprising hydrocarbonaceous material is introduced into a first mixing zone 14 through a conduit 10. The hydrocarbonaceous material comprises coal liquefaction products or fractions thereof containing soluble coal products and insoluble coal products produced by any process for the liquefaction of coal or other carbonaceous materials including products such as pitch, tar or the like resulting from the destructive distillation of carbonaceous materials such as coal, coke or the like and particularly product fractions comprising substantially non-distillable soluble coal products, that is, fractions having an initial boiling point temperature above 950 degrees F. at one atmosphere (the above products hereinafter collectively being referred to as comprising soluble coal products and insoluble coal products).

In the first mixing zone 14, the feed is contacted by and mixed with a deashing solvent introduced through a conduit 12 to provide a feed mixture. Sufficient deashing solvent is introduced into the mixing zone 14 to provide a ratio by weight of deashing solvent to feed in the feed mixture of from about 1:1 to about 10:1. It is to be understood that larger quantities of solvent can be employed, however, such use is uneconomical. The feed mixture is discharged from the first mixing zone 14 through a conduit 16 to enter a first separation zone 20, comprising, for example, a separating vessel.

The first separation zone 20 is maintained at an elevated temperature and pressure to effect a separation of the feed mixture into a fluid-like first light phase comprising soluble coal products and deashing solvent and a fluid-like first heavy phase comprising insoluble coal products and some deashing solvent.

The first light phase separates in an upper portion 22 of first separation zone 20 and the first heavy phase collects in a lower portion 24 of first separation zone 20.

The first separation zone 20 is maintained at a temperature level in the range of from about 400 degrees F. to about 700 degrees F. The pressure level is maintained in the range of from about 600 psig. to about 1500 psig.

The particular temperature and pressure conditions are selected to maximize the yield of recoverable soluble coal products in the first light phase; however, such conditions result in the fluid-like first heavy phase becoming non-flowable.

To permit the first heavy phase to be withdrawn from the lower portion 24 of first separation zone 20 an additional quantity of deashing solvent is introduced into the first heavy phase through a conduit 18. The deashing solvent is introduced into first separation zone 20 beneath the interface separating the first light phase and the first heavy phase. The deashing solvent admixes with the first heavy phase to reduce the viscosity of the mixture and thereby cause the first heavy phase to be flowable upon withdrawal from the first separation zone 20. The deashing solvent is introduced into the lower portion 24 of first separation zone 20 in sufficient quantity to provide a ratio by weight of deashing solvent to first heavy phase of from about 0.04:1 to about 10:1. The preferred ratio of deashing solvent to first heavy phase is in the range of from about 0.08:1 to about 0.25:1.

It is interesting to note that increasing the quantity of deashing solvent present in the feed mixture introduced into separation zone 20 fails to prevent the separated first heavy phase from being nonflowable.

The first heavy phase, now flowable as a result of the introduction of the deashing solvent into the lower portion 24 of first separation zone 20, is withdrawn from the first separation zone 20 through a conduit 26. The first heavy phase then is introduced into a solvent recovery zone 28 wherein the deashing solvent is separated for recycle and utilization in preparing additional feed mixture. The deashing solvent is withdrawn through a conduit 30 from the solvent recovery zone 28. The insoluble coal products are withdrawn from solvent recovery zone 28 through a conduit 32.

In one preferred embodiment, solvent recovery zone 28 comprises a flash vessel. The first heavy phase is introduced into the flash vessel whereupon the pressure thereon is reduced by at least about 100 psig. by flashing to produce at least an overhead stream comprising deashing solvent and another stream comprising insoluble coal products in a dry, powdery, easily flowable form.

In an alternate embodiment of the present invention, the additional quantity of deashing solvent can be introduced into the withdrawal conduit 26, rather than into the separation zone 20, to impart flowability to the first heavy phase. Preferably, the additional deashing solvent is introduced into withdrawal conduit 26 near the entrance thereto, however, the deashing solvent also can be introduced into conduit 26, for example, near mid-length or any other position.

The first light phase is withdrawn from the first separation zone 20 through a conduit 34 and introduced into a second separation zone 36, comprising, for example, a second separating vessel. The second separation zone 36 is maintained at a temperature level higher than the temperature level in the first separation zone 20 and a pressure level substantially the same or below the pressure level in the first separation zone 20 to effect a separation of the first light phase therein. Preferably, the temperature level in the second separation zone 36 is maintained in the range of from about 410 degrees F. to about 900 degrees F. and the pressure level is maintained in the range of from about 590 psig. to about 1500 psig.

The particular temperature and pressure conditions in the second separation zone 36 are selected to provide a differential in the deashing solvent density in the first light phase sufficiently large to cause the first light phase to separate into two fluid-like phases. The first light phase separates into a second light phase comprising deashing solvent and a second heavy phase comprising soluble coal products and some deashing solvent. The second light phase is withdrawn from the second separation zone 36 through a conduit 38 for recycle to the first mixing zone 14. The second heavy phase is withdrawn from the second separation zone 36 through a conduit 40 and introduced into a solvent recovery zone 42 wherein the deashing solvent is separated for recycle.

In one preferred embodiment, solvent recovery zone 42 comprises a flash vessel. The second heavy phase is introduced into the flash vessel whereupon it is flashed to produce at least an overhead stream comprising deashing solvent and another stream comprising soluble coal products. The separated deashing solvent is withdrawn from the solvent recovery zone 42 through conduit 44. The soluble coal products are withdrawn from the solvent recovery zone 42 through a conduit 46 for recovery.

In an alternate embodiment of the present invention, the temperature and pressure conditions within the second separation zone are selected to cause said first light phase to separate into a second light phase comprising deashing solvent and a portion of the soluble coal products and a second heavy phase comprising the remainder of the soluble coal products and some deashing solvent. The second light phase then is withdrawn from the second separation zone 36 and introduced into a subsequent separation zone (not shown) operated to separate the deashing solvent from the soluble coal products.

This process permits the soluble coal products to be separated into various fractions that may not be separable by distillation, such as when the soluble coal products are a portion of a substantially non-distillable coal liquefaction product fraction.

Figure 2:
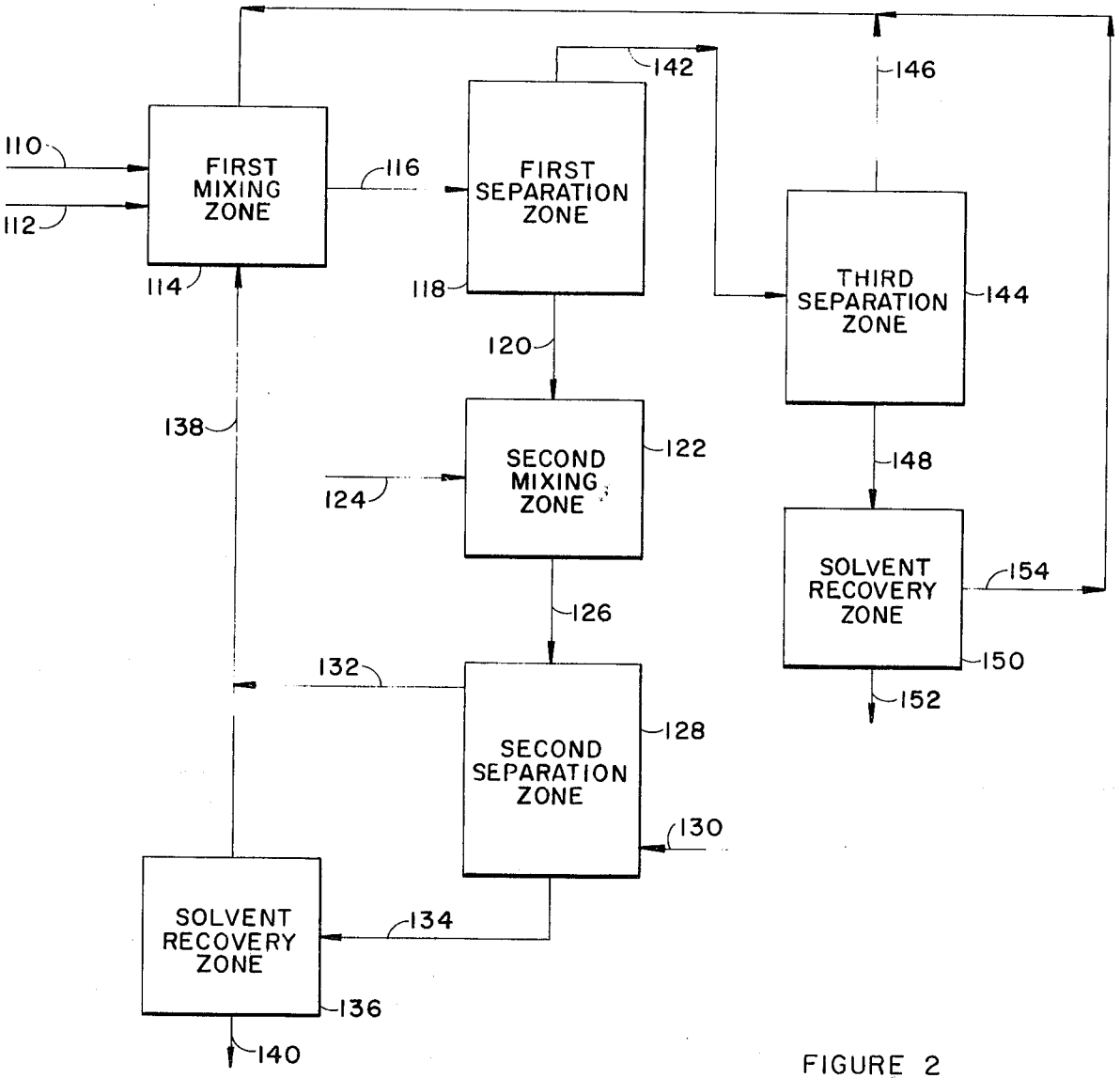
FIG. 2 schematically illustrates an alternate process utilizing the present invention.

Turning now to FIG. 2, another embodiment of the present invention is illustrated. A feed comprising coal liquefaction products is introduced through a conduit 110 into a first mixing zone 114. The feed is contacted by and mixed with a deashing solvent introduced into first mixing zone 114 through a conduit 112 to provide a feed mixture. Sufficient deashing solvent is introduced to provide a ratio by weight of deashing solvent to feed in the feed mixture of from about 1:1 to about 10:1. The feed mixture is discharged from the first mixing zone 114 through a conduit 116 to enter a first separation zone 118.

The first separation zone 118 is maintained at a temperature level in the range of from about 450 degrees F. to about 800 degrees F. and a pressure level in the range of from about 600 psig. to about 1500 psig. to cause the feed mixture to separate. The feed mixture separates into a first light phase comprising soluble coal products and deashing solvent and a first heavy phase comprising insoluble coal products, some soluble coal products and some deashing solvent.

The particular temperature and pressure conditions in the first separation zone 118 are selected to ensure that the soluble coal products separated as the first light phase will contain less than about 0.1 percent ash by weight.

The first heavy phase is withdrawn from the first separation zone 118 through a conduit 120 and introduced into a second mixing zone 122. In the second mixing zone 122, the first heavy phase is contacted by and mixed with an additional portion of deashing solvent introduced into the mixing zone 122 through a conduit 124 to provide a easily flowable mixture. The particular quantity of deashing solvent introduced into second mixing zone 122 may vary so long as a sufficient quantity is present to cause the first heavy phase to be easily flowable therefrom. The mixture then is passed through a conduit 126 to enter a second separation zone 128.

The second separation zone 128 is maintained at an elevated temperature and pressure to effect a separation of the mixture into a fluid-like second light phase comprising soluble coal products and deashing solvent and a fluid-like second heavy phase comprising insoluble coal products and some deashing solvent. The particular temperature and pressure conditions are selected to maximize the yield of recoverable soluble coal products from the first heavy phase. In generally, the conditions are such that the temperature of the second separation zone 128 is less than the temperature maintained in the first separation zone 118 and the pressure level is maintained at about the same level. More particularly, the second separation zone 128 is maintained at a temperature level in the range of from about 400 degrees F. to about 700 degrees F. and a pressure level in the range of from about 600 psig. to about 1500 psig. The operation of the second separation zone 128 to maximize the yield of recoverable soluble coal products results in the fluid-like second heavy phase becoming nonflowable. To permit the second heavy phase to be withdrawn from the second separation zone 128 an additional quantity of deashing solvent is introduced into the second heavy phase contained within said second separation zone 128 through a conduit 130. The deashing solvent admixes with the second heavy phase to reduce the viscosity of the mixture and thereby cause the second heavy phase to be flowable upon withdrawal from the second separation zone 128. The deashing solvent is introduced into the second heavy phase in sufficient quantity to provide a ratio by weight of deashing solvent to second heavy phase of from about 0.04:1 to about 10:1.

The second heavy phase, now flowable as a result of the introduction of the deashing solvent, is withdrawn from the second separation zone 128 through a conduit 134 and introduced into a solvent recovery zone 136. In the solvent recovery zone 136, the second heavy phase mixture is flashed to produce at least an overhead stream comprising deashing solvent and another stream comprising insoluble coal products. The deashing solvent stream is withdrawn from solvent recovery zone 136 and passed to the first mixing zone 114 via a conduit 138. The insoluble coal products are withdrawn from the solvent recovery zone 136 through a conduit 140.

The second light phase is withdrawn from the second separation zone 128 through a conduit 132 which connects to conduit 138 for recycle of the second light phase to the first mixing zone 114. The recycle of the second light phase aids in providing deasing solvent for preparation of the feed mixture and improves the ultimate recovery of the soluble coal products separated as the first light phase in the first separation zone 118.

The first light phase is withdrawn from the first separation zone 118 through a conduit 142 and introduced into a third separation zone 144. The third separation zone 144 is maintained at a temperature level in the range of from about 500 degrees F. to about 900 degrees F. and a pressure level of from about atmospheric pressure to about 1500 psig.

In the third separation zone 144, the first light phase separates into a third light phase comprising deashing solvent and a third heavy phase. In those instances in which the pressure level in the third separation zone 144 is maintained substantially the same as the pressure level in the first separation zone 118, the third heavy phase will comprise soluble coal products and some deashing solvent. When operating under said conditions, the third heavy phase is withdrawn from the third separation zone 144 through a conduit 148 and introduced into a solvent recovery zone 150.

In the solvent recovery zone 150, the third heavy phase is separated, for example by flashing, into an overhead stream comprising deashing solvent and another stream comprising soluble coal products. The soluble coal products are withdrawn from the solvent recovery zone 150 through a conduit 152 for recovery. The deashing solvent is withdrawn from the solvent recovery zone 150 through a conduit 154 for recycle in the process.

In those instances in which the pressure level existant within the third separation zone 144 is substantially less than the pressure level within the first separation zone 118, the third heavy phase will consist essentially of soluble coal products. Under these circumstances, the third heavy phase is withdrawn from the third separation zone 144 and recovered without additional treatment for deashing solvent recovery.

The third light phase is withdrawn from the third separation zone 144 through a conduit 146 for recycle to the first mixing zone 114 to aid in providing the feed mixture.

For the purpose of illustrating the present invention, and not by way of limitation, the following example is provided.

EXAMPLE

A feed mixture is prepared by mixing coal liquefaction products with a deashing solvent (comprising toluene) in a ratio of about one part by weight of coal liquefaction products to about 2.8 parts by weight of toluene at a pressure level in the range of from about 600 psig. to about 1500 psig. and a temperature level in the range of from about 400 degrees F. to about 700 degrees F.

A first test is performed in which the feed mixture is separated within the first separation zone 20 (FIG. 1) into a first light and a first heavy phase and the separated phases are continuously withdrawn without the use of additional deashing solvent introduced into the heavy phase while gradually reducing the operating temperature of the separation zone. A second test then is performed in which the feed mixture is separated into a first light and a first heavy phase which are continuously withdrawn while an additional quantity of deashing solvent is introduced through conduit 18 into the first heavy phase below the interface level within the first separation zone 20 and the operating temperature is gradually reduced.

In the first test, the feed mixture continuously is introduced into the first separation zone 20 which is maintained at a pressure level of about 800 psig. and a temperature level above 600 degrees F. to cause the feed mixture to separate into a first light phase and a first heavy phase. The first heavy phase continuously is withdrawn from the first separation zone through a conduit having a pressure reduction valve interposed therein. The temperature level within the first separation zone gradually is lowered while feed mixture introduction and first heavy phase withdrawal are continued. At a temperature of about 555 degrees F. the fluid-like first heavy phase becomes nonflowable and the pressure reduction valve in the withdrawal conduit plugs with solidified heavy phase material.

The yield of recovered soluble coal from the feed mixture prior to plugging is about 81 percent, by weight determined by cresol solubility at 1 atmosphere pressure and the boiling point temperature of cresol.

In the second test, the feed mixture continuously is introduced into the first separation zone which is maintained at a pressure level of about 800 psig. and a temperature level above 575 degrees F. to cause the feed mixture to separate. The first heavy phase continuously is withdrawn from the first separation zone through the conduit in which a pressure reduction valve is interposed while an additional quantity of deashing solvent is introduced into the first heavy phase below the interface level within the first separation zone 20. The ratio, by weight, of deashing solvent introduced into the heavy phase mixture to the first heavy phase is about 0.15:1. The temperature level within the first separation zone gradually is lowered while feed mixture introduction, first heavy phase withdrawal and deashing solvent introduction are continued. The temperature gradually is reduced to about 525 degrees F. while the first heavy phase remains fluid-like and easily flowable.

The yield of recovered soluble coal in the second test from the feed mixture is greater than 86 percent, by weight.

The benzene solubles content of the first heavy phase (which includes the deashing solvent) in the second test is determined by known techniques wherein benzene solubles is defined as 100 minus benzene insolubles, with benzene insolubles as known in the art. The benzene solubles content of the first heavy phase is less than 35 percent, by weight.

A comparison of the soluble coal yield of the second test with the yield of the first test clearly demonstrates the improvement in soluble coal yield that is possible through the practice of the present invention. Further, the first heavy phase is flowable under conditions in which the benzene solubles content is below 35 percent, by weight, which previously has not been considered possible by persons skilled in this art.

In the process described above, the term "deashing solvent" means a fluid consisting essentially of at least one substance having a critical temperature below 800 degrees F. selected from the group consisting of: aromatic hydrocarbons having a single benzene nucleus and normal boiling points below about 310 degrees F., such as benzene, toluene, o-, m- and p-xylene, ethyl benzene, isopropyl benzene and monocyclic aromatic hydrocarbons in general having normal boiling points below about 310 degrees F.; cycloparaffin hydrocarbons having normal boiling points below about 310 degrees F., such as cyclobutane, cyclopentane, cyclohexane, cycloheptane and nonaromatic monocyclic hydrocarbons in general having normal boiling points below about 310 degrees F.; open chain mono-olefin hydrocarbons having normal boiling points below about 310 degrees F., such as butene, pentene, hexene and heptene; open chain saturated hydrocarbons having normal boiling points below about 310 degrees F., such as pentane, hexane and heptane; mono-, di, and tri-open chain amines containing from about 2–8 carbon atoms, such as ethyl, propyl, butyl, pentyl, hexyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs. Such fluids and their usefulness is described further in U.S. Pat. Nos. 3,607,716 and 3,607,717 the disclosures of which are incorporated herein by reference.

The term "insoluble coal products" means undissolved coal, mineral matter, other solid inorganic particulate matter and other such matter which is insoluble in the deashing solvent under the conditions of this invention.

The term "ash" means the residue remaining after the combustion of insoluble coal products.

The term "soluble coal products" means the constituents of the feed that are soluble in the deashing solvent under the conditions of this invention.

While the present invention has been described with respect to what are considered to be the preferred embodiments thereof, it is to be understood that changes or modifications can be made in the process without departing from the spirit or scope of the invention as defined by the following claims.

What is claimed is:

1. A process comprising:

providing a hydrocarbonaceous feed comprising soluble coal products and insoluble coal products;

providing a deashing solvent consisting essentially of at least one substance having a critical temperature below 800 degrees F. selected from the group consisting of aromatic hydrocarbons having a single benzene nucleus and normal boiling points below about 310 degrees F., monocyclic aromatic hydrocarbons having normal boiling points below about 310 degrees F., cycloparaffin hydrocarbons having normal boiling points below about 310 degrees F., nonaromatic monocyclic hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

admixing said feed and said solvent in a mixing zone to provide a feed mixture;

introducing said feed mixture into a first separation zone maintained at an elevated temperature and pressure to effect a separation of said feed mixture into a fluid-like first light phase comprising soluble coal products and deashing solvent and a fluid-like substantially nonflowable first heavy phase comprising insoluble coal products, some soluble coal products and some deashing solvent;

introducing an additional quantity of deashing solvent into said first heavy phase to impart flowability to said first heavy phase;

withdrawing the first light phase from the first separation zone; and withdrawing the first heavy phase from the first separation zone.

2. The process of claim 1 defined further to include the steps of:

introducing said withdrawn first heavy phase into a solvent recovery zone to separate at least a portion of the deashing solvent contained in said first heavy phase; and recovering said deashing solvent separated in said solvent recovery zone.

3. The process of claim 1 wherein maintaining the first separation zone at an elevated temperature and pressure is defined further as:

maintaining said first separation zone at a temperature level in the range of from about 400 degrees F. to about 700 degrees F. and a pressure level in the range of from about 600 psig. to about 1500 psig.

4. The process of claim 1 wherein said additional quantity of deashing solvent introduced into said first heavy phase is defined further as:

introducing said deashing solvent into said first heavy phase within said first separation zone in a ratio, by weight, of deashing solvent to first heavy phase in the range of from about 0.04:1 to about 10:1.

5. The process of claim 1 wherein said additional quantity of deashing solvent introduced into said first heavy phase is defined further as:

introducing said deashing solvent into said first heavy phase within said first separation zone in a ratio, by weight, of deashing solvent to first heavy phase in the range of from about 0.08:1 to about 0.25:1.

6. A process comprising:

providing a hydrocarbonaceous feed comprising soluble coal products and insoluble coal products;

providing a deashing solvent consisting essentially of at least one substance having a critical temperature below 800 degrees F. selected from the group consisting of aromatic hydrocarbons having a single benzene nucleus and normal boiling points below about 310 degrees F., monocyclic aromatic hydrocarbons having normal boiling points below about 310 degrees F., nonaromatic monocyclic hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

admixing said feed and said solvent in a mixing zone to provide a feed mixture;

introducing said feed mixture into a first separation zone maintained at a temperature level in the range of from about 450 degrees F. to about 800 degrees F. and a pressure level in the range of from about 600 psig. to about 1500 psig. to effect a separation of said feed mixture into a first light phase containing less than 0.1 percent ash, by weight, and a first heavy phase;

withdrawing said first light phase from said first separation zone for recovery;

withdrawing said first heavy phase from said first separation zone;

introducing said withdrawn first heavy phase into a second mixing zone wherein said heavy phase is admixed with additional deashing solvent to provide a mixture;

introducing said mixture from the second mixing zone into a second separation zone maintained at a temperature level less than the temperature level in the first separation zone and at a pressure level in the range of from about 600 psig. to about 1500 psig. to effect a separation of said mixture into a fluid-like second light phase comprising soluble coal products and deashing solvent and a substantially nonflowable fluid-like second heavy phase comprising insoluble coal products and some deashing solvent;

introducing an additional quantity of deashing solvent into said second heavy phase to impart flowability to said second heavy phase;

withdrawing said second light phase from said second separation zone; and withdrawing said second heavy phase from said second separation zone.

7. The process of claim 6 defined further to include the step of:

recycling said second light phase to said first mixing zone to provide deashing solvent for preparation of said feed mixture.

8. The process of claim 6 wherein said additional quantity of said deashing solvent introduced into said second heavy phase is defined further as:

introducing said deashing solvent into said second heavy phase in a ratio, by weight, of deashing solvent to second heavy phase in the range of from about 0.04:1 to about 10:1.

9. The process of claim 6 wherein said additional quantity of said deashing solvent introduced into said second heavy phase is defined further as:

introducing said deashing solvent into said second heavy phase in a ratio, by weight, of deashing solvent to second heavy phase in the range of from about 0.08:1 to about 0.25:1.

10. The process of claim 6 wherein the temperature level maintained in the second separation zone is defined further as:

maintaining the temperature level in said second separation zone in the range of from about 400 degrees F. to about 700 degrees F.

* * * * *